US007114278B2

(12) United States Patent
Marks et al.

(10) Patent No.: US 7,114,278 B2
(45) Date of Patent: Oct. 3, 2006

(54) PERSONALIZED PICTURE FRAME ASSEMBLY

(76) Inventors: Jeffrey Marks, 132 E. Delaware Pl., Apt. 4905, Chicago, IL (US) 60603; Rose K. Marks, 132 E. Delaware Pl., Apt. 4905, Chicago, IL (US) 60603

( * ) Notice: Subject to any disclaimer, the term of this patent is extended or adjusted under 35 U.S.C. 154(b) by 0 days.

(21) Appl. No.: 10/843,800

(22) Filed: May 12, 2004

(65) Prior Publication Data

US 2005/0252059 A1 Nov. 17, 2005

(51) Int. Cl.
*A47G 1/06* (2006.01)

(52) U.S. Cl. ..... 40/722; 40/700

(58) Field of Classification Search ..... 40/490, 40/491, 618, 620, 621, 711, 798, 799, 600, 40/700, 722; D6/300
See application file for complete search history.

(56) References Cited

U.S. PATENT DOCUMENTS

| | | | | | |
|---|---|---|---|---|---|
| 337,033 | A * | 3/1886 | Thonssen | 40/799 |
| 1,168,949 | A * | 1/1916 | McKittrick et al. | 434/168 |
| 1,851,917 | A * | 3/1932 | Maggio | 40/799 |
| 2,185,853 | A * | 1/1940 | Knoess | 24/429 |
| 2,223,674 | A * | 12/1940 | Cohen | 40/799 |
| 2,669,964 | A * | 2/1954 | Wexler | 116/324 |
| 2,869,261 | A * | 1/1959 | Audette | 40/209 |
| 3,336,682 | A * | 8/1967 | Genin | 434/416 |
| 4,166,673 | A * | 9/1979 | Dona | 359/515 |
| 4,924,611 | A * | 5/1990 | Shaw | 40/210 |
| 5,303,488 | A | 4/1994 | Todd et al. | |
| 6,010,338 | A * | 1/2000 | Watson | 434/81 |
| D420,810 | S | 2/2000 | Mounsey | |
| 6,182,387 | B1 * | 2/2001 | Duguay | 40/621 |
| 6,338,214 | B1 * | 1/2002 | Held | 40/620 |
| 6,347,467 | B1 | 2/2002 | Meyer | |
| 6,418,652 | B1 | 7/2002 | Crawford | |
| 6,510,631 | B1 | 1/2003 | Baggerly | |
| 6,510,638 | B1 | 1/2003 | Wang | |
| 6,550,172 | B1 | 4/2003 | Korpai | |
| 6,574,897 | B1 | 6/2003 | Timmer | |
| 6,688,029 | B1 * | 2/2004 | Dunn | 40/711 |

* cited by examiner

*Primary Examiner*—Lesley D. Morris

(57) ABSTRACT

A picture frame assembly in which tiles bearing letters, numerals, symbols or other indicia are affixed to the frame to provide a personalized or customized appearance. The tiles may slide within a groove integrally formed in the frame or be magnetically attached to the frame. In the non-magnetic embodiment, the tiles have raised rails extending from the perimeter of the tile which hold the tile to the frame. The rails may be spring loaded (retractable) for easier mounting.

1 Claim, 3 Drawing Sheets

PERSONALIZED PICTURE FRAME ASSEMBLY

BACKGROUND

1. Field of the Invention

This patent relates to a frame. More particularly, this patent relates to a picture frame bearing a personalized message or other indicia.

2. Description of the Related Art

Pictures mounted in picture frames are a common sight in homes and offices. The pictures and frames usually do not identify the persons or places in the picture or the date the picture was taken, or the occasion commemorated. Over time people can forget these details and wish they could recall them, or at least provided a means of remembering them.

Thus it is an object of the present invention to provide a picture frame that identifies the persons or places in the picture, the date the picture was taken, or the occasion commemorated.

Another object of the invention is to provide a frame for a photograph or the like that bears indicia personalizing the frame.

Yet another object of the invention is to provide a frame bearing a personalized message that can be changed as desired.

Further and additional objects will appear from the description, accompanying drawings, and appended claims.

SUMMARY OF THE INVENTION

The present invention is a picture frame assembly in which tiles bearing letters, numerals, symbols or other indicia are affixed to the frame or to the glass protecting the framed picture to provide a personalized or customized appearance. In a first embodiment of the invention, tiles slide within a groove integrally formed in the frame. The tiles have raised rails extending from the perimeter of the tile which hold the tile to the frame.

In a second embodiment of the invention, the tiles and/or frame have magnetic properties that allow the tiles to be placed anywhere on the frame.

In a third embodiment of the invention, the tiles have spring loaded (retractable) rails extending from the perimeter of the tiles. The tiles are attached to the frame by pressing the tiles into C-shaped tracks integrally formed in the frame.

With all three embodiments, the tiles may be mounted to an optional holder that is then affixed to the frame or protective glass by adhesive or other means.

THE DRAWINGS

Figure 15:
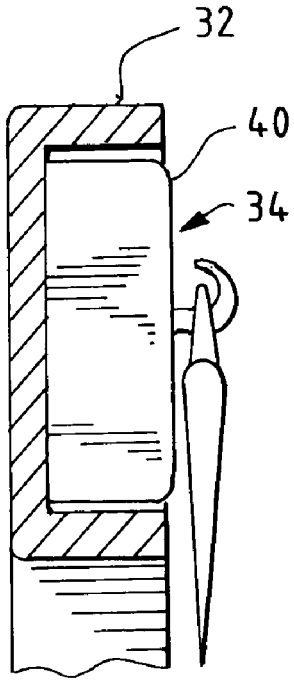

FIG. 15 side view of a magnetic charm disposed within a frame according to the magnetic embodiment of the invention.

DETAILED DESCRIPTION OF THE INVENTION

In general, the invention is a picture frame assembly in which tiles bearing letters, numerals, symbols or other indicia are affixed to the frame to provide a personalized appearance. Turning to the drawings, there is shown in FIGS. 1–4 a first embodiment of the invention, in which links or tiles slide within a groove integrally formed in the frame. The assembly 10 comprises a frame 12 and sliding links or tiles 14 or sliding charms 16 (collectively "tiles") that can be mounted within the frame 12 as described below.

Figure 1:
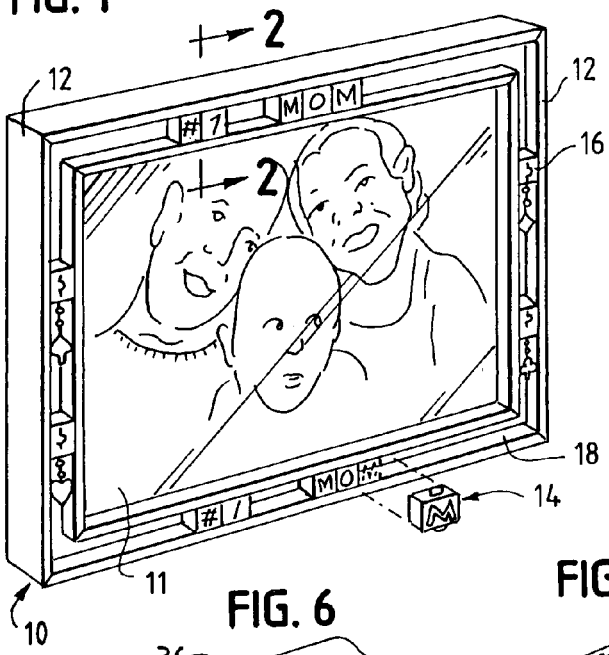
FIG. 1 is a perspective view of a personalized picture frame according to a first (sliding tile) embodiment of the invention.

FIG. 1 is a perspective view of the assembly 10. In this embodiment, the frame 12 is provided with an integrally formed groove 18 coextensive with the frame 12. Tiles 14 are mounted within the frame 12 along the top, bottom and sides of the picture 11.

Figure 2:
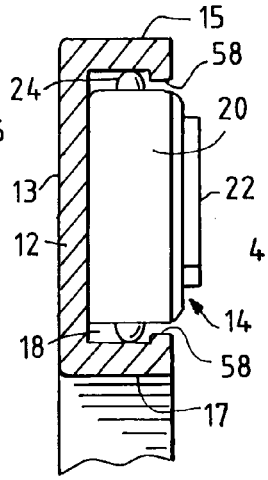
FIG. 2 is a cross sectional view of the picture frame of FIG. 1, taken along line 2—2.

As best shown in FIG. 2, the frame 12 has a substantially C-shaped cross-section and comprises a rear wall 13, top and bottom walls 15, 17 perpendicular to the rear wall 13, and inwardly extending opposing rims 58 which define the groove 18 within which the sliding tiles 14 or charms 16 are mounted. The frame 12 may be constructed of metal, plastic or any suitable material.

Each tile 14 comprises a body 20 having a front surface upon which is mounted a letter, numeral, symbol or other indicia 22. Raised projections or rails 24 extend from the perimeter of the tile body 20. Preferably, the rails 24 extend from the top and bottom of the body 20 as shown in FIGS. 1–4, but can also extend from the sides.

Figure 4:
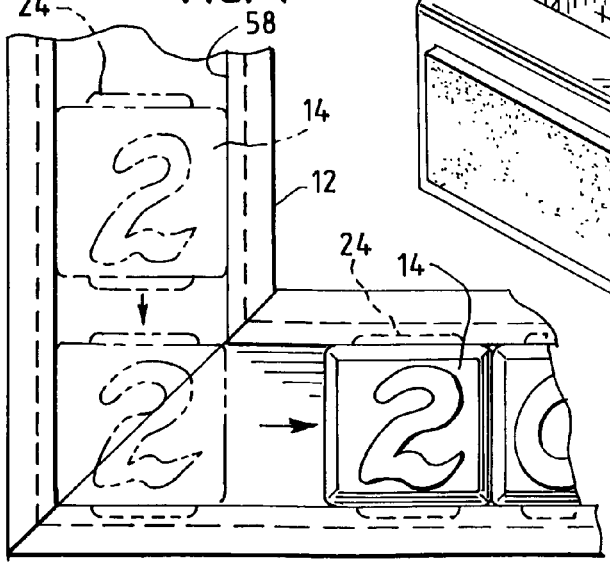
FIG. 4 is a front partial view of sliding tile mounted within a frame.

Referring to FIG. 4, the user mounts the desired tiles 14 in the frame 12 as follows. If a tile 14 has rails 24 on the top and bottom, the tile 14 is first placed within a vertically oriented portion of the frame 12 (along the sides of the picture 11). In this position the rails 24 are not yet captured by the frame 12. The tile 14 is then be slid downward (or upward) to a corner of the frame 12 and then laterally to the desired position where the rails 24 are captured by the inwardly extending opposing rims 58 of the frame 12. Conversely, if the tile 16 has rails 24 located on the sides of the tile 16, the tile 16 is first placed within a horizontally oriented portion of the frame, slid sideways until it is located at a corner of the frame 12, and then slid upwards or downwards to the desired position along the frame 12. The rails 24 fit within the C-shaped frame 12 and extend behind the rims 58 to hold the tiles 14 within the frame 12. The tiles 14 can be changed as often as desired, such as when the picture mounted inside the frame 12 is changed.

Figure 3:
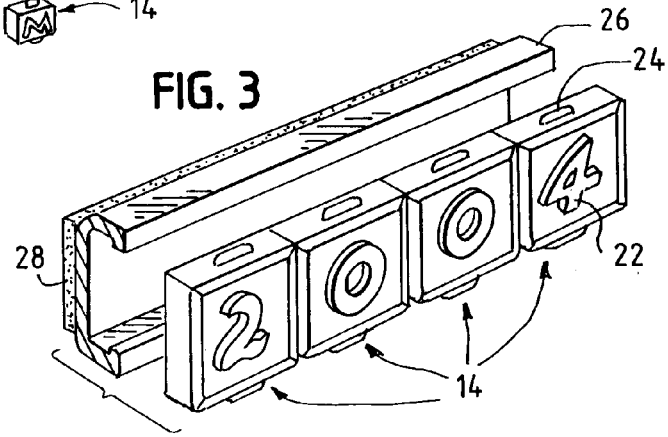
FIG. 3 is a front perspective view of a group of sliding tiles and a tile holder that can be affixed to a frame or a protective glass surface.

Rather than mount the individual tiles 14 directly within frame 12 as shown in FIGS. 1 and 2, the tiles 14 can first be mounted within a tile holder 26 that is then affixed to the frame 12 or to the protective glass covering the picture 11 mounted within the frame 12. FIG. 3 shows such an arrangement. The holder 26, like the frame 12 in FIGS. 1 and 2, has a generally C-shaped cross-section, and has an adhesive backing 28 to affix the holder 26 to the frame 12 or to the glass protecting the picture 11.

Figure 5:
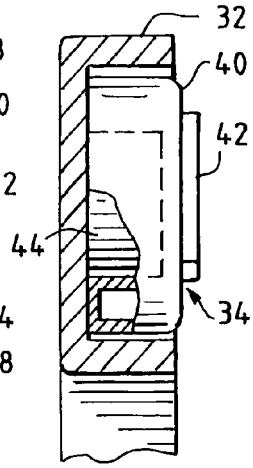
FIG. 5 is a side view of a magnetic tile disposed within a frame according to a second (magnetic) embodiment of the invention.

FIGS. 5–7 and 15 show a second embodiment of the invention, one in which the tiles and/or frame have magnetic properties that secure the tiles to the frame. FIG. 5 is a side view of a magnetic tile 34 affixed to a frame 32 according to the second (magnetic) embodiment of the invention. Each magnetic tile 34 comprises a body 40, indicia 42 mounted on the front surface of the body 40 and a magnetic element 44 having a rearward exposed surface. FIG. 15 is a side view of a magnetic tile 34 having a charm mounted to its front surface instead of indicia. To assemble a personalized frame, the user mounts the desired tiles 34 on the frame 32 by placing the tiles against the frame 32. The frame 32 need not have a C-shaped cross-section as shown in FIG. 5; it may be flat or any other suitable shape. If the tiles 34 are magnetic as shown in FIG. 5, the frame 32 must contain metal so that the tiles adhere magnetically to the frame 32. Conversely, the frame 32 can be made from magnetic material and the tiles 34 can be metal.

Figure 6:
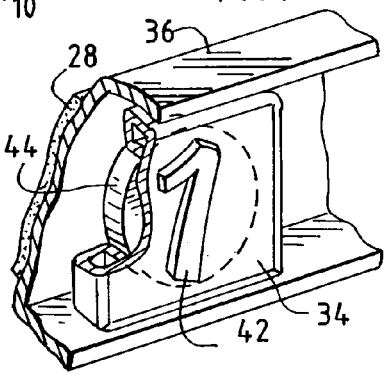
FIG. 6 is a partial cutaway view of a magnetic tile mounted within a tile holder.
Figure 7:
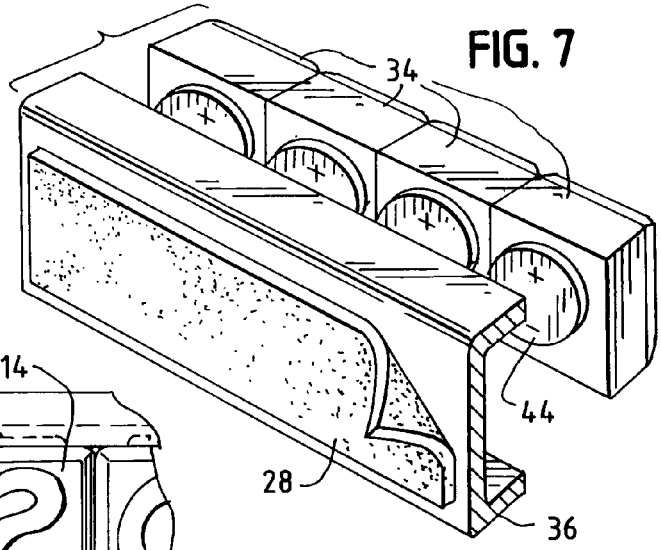
FIG. 7 is rear perspective view of a group of magnetic tiles mounted within a tile holder.

As with the first (sliding tile) embodiment, the magnetic tiles 34 can also be mounted to a tile holder 36 that is then affixed to the frame 32 or to the protective glass covering the picture within the frame 32. FIGS. 6 and 7 show such an arrangement. The holder 36 has a general C-shaped cross-section to better align the tiles 34. The holder 36 may have an adhesive backing 28 to help adhere the holder 34 to the frame 32 or to the picture glass.

Figure 8:
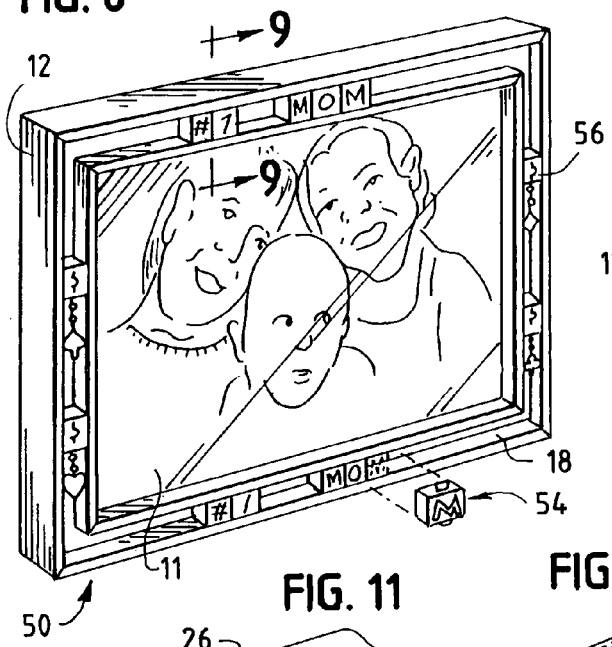
FIG. 8 is a perspective view of a personalized picture frame according to a third (spring loaded tile) embodiment of the invention.

FIGS. 8–14 show a third embodiment of the invention, one in which the tiles have spring loaded rails which retract when pressed in. FIG. 8 is a perspective view of a personalized picture frame 50 according to the third (spring loaded tile) embodiment of the invention. Tiles 54 and/or charms 56 bearing indicia 62 are placed within the frame 12 and bear indicia that personalizes the frame.

Figure 9:
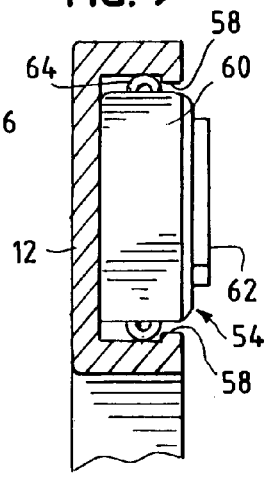
FIG. 9 is a cross sectional view of the picture frame of FIG. 8, taken along line 9—9.

FIG. 9 is a cross sectional view of a spring loaded tile 54 affixed to a frame 12 according to the third (spring loaded) embodiment of the invention. Each spring loaded tile 54 comprises a body 60 and indicia 62 mounted on the front of the body 60. Spring loaded rails 64 extend from the perimeter of the body 60. Preferably, the spring loaded rails 64 extend from the top and bottom of the body 60 as shown in FIGS. 8–14, but they can also extend from the sides. The spring loaded rails 64 fit within the C-shaped frame 12 and behind the inwardly extending opposing rims 58 to hold the tiles 54 to the frame 12.

Figure 14:
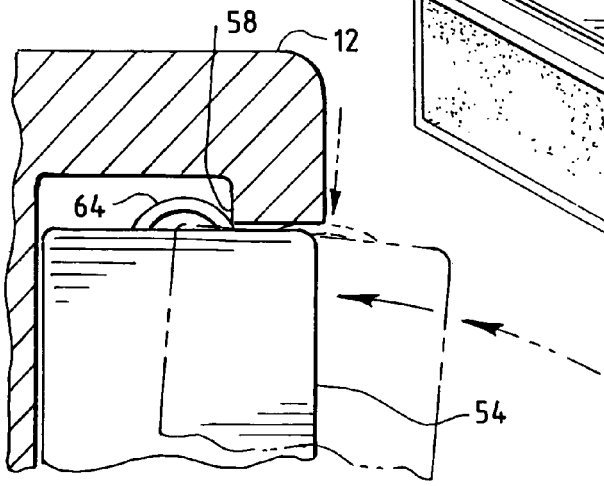
FIG. 14 is a side view of a spring loaded tile as it is being inserted into a frame.

To personalize a frame 12 with spring loaded tiles 54 or charms 56, the user mounts the desired tiles 54 or charms 56 in the frame 12 by pressing the tiles 54 into the groove 18 defined by the frame 12. The rails 64 will temporarily retract to allow the tiles 54 to fit between the inwardly extending rims 58 of the frame 12 as shown in FIG. 14.

Figure 10:
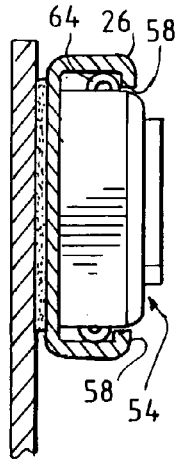
FIG. 10 is a side view of a spring loaded tile mounted within a tile holder adhered to a surface.
Figure 11:
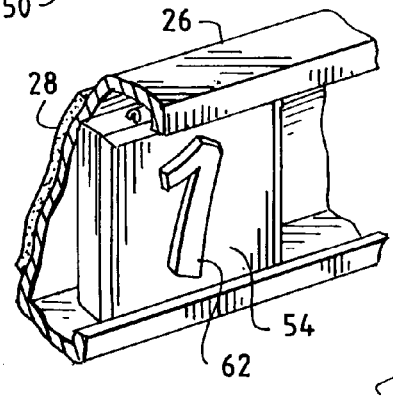
FIG. 11 is a partial cutaway view of a spring loaded tile mounted within a tile holder.
Figure 12:
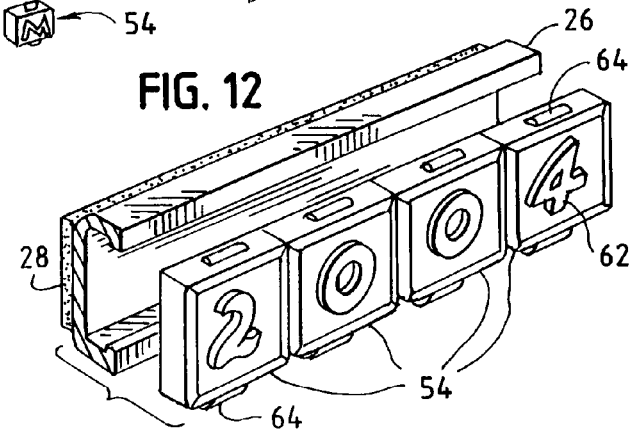
FIG. 12 is a front perspective view of a group of spring loaded tiles and a tile holder.
Figure 13:
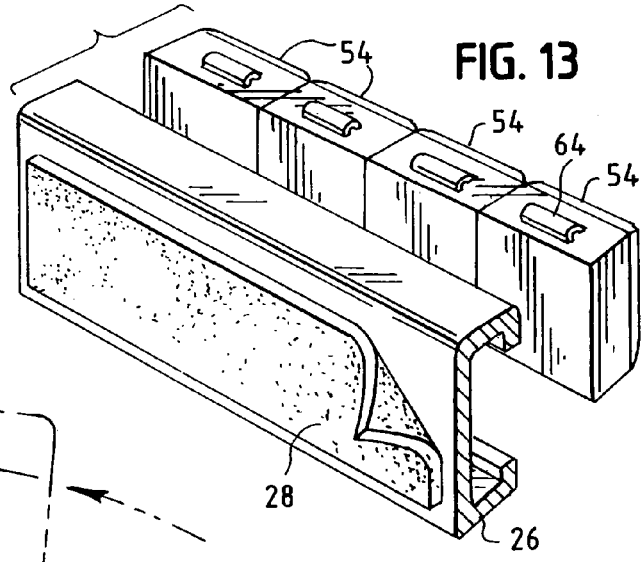
FIG. 13 is a rear perspective view of a group of spring loaded tiles and a tile holder.

As with the first (sliding tile) and second (magnetic) embodiment, the spring loaded tiles 54 can also be mounted to a tile holder 26 that is then affixed to the frame 12 or glass. FIGS. 10–13 show such an arrangement. The holder 26 has a generally C-shaped cross-section with inwardly extending opposing rims 58 as best shown in FIG. 10. The holder 26 may have an adhesive backing 28 to adhere the holder 26 to the frame 12.

Other modifications and alternative embodiments of the invention are contemplated which do not depart from the scope of the invention as defined by the foregoing teachings and appended claims. It is intended that the claims cover all such modifications that fall within their scope. For example, it is anticipated that the charms 16 may be manufactured and sold as "blank" tiles having a small hook or other attachment means on the front surface and separate charms that hang on the hooks or are otherwise attached to the blank tile.

We claim as our invention:

1. A personalized frame assembly comprising:

a substantially rectangular picture frame having a perimeter, an opening defined by the perimeter for displaying a picture, and a groove integrally formed in the perimeter of the picture frame and circumscribing the opening; and one or more tiles mountable within the groove, the one or more tiles having a front surface bearing indicia, wherein the picture frame has a substantially C-shaped cross-section defining the groove, and wherein the picture frame groove comprises a rear wall having a metallic surface and top and bottom walls perpendicular to the rear wall, and wherein the one or more tiles comprise a magnetic element that adheres to the rear wall.

* * * * *